US010242660B2

(12) United States Patent
Hao et al.

(10) Patent No.: US 10,242,660 B2
(45) Date of Patent: Mar. 26, 2019

(54) METHOD AND DEVICE FOR OPTIMIZING SPEECH SYNTHESIS SYSTEM

(71) Applicant: BAIDU ONLINE NETWORK TECHNOLOGY (BEIJING) CO., LTD., Beijing (CN)

(72) Inventors: Qingchang Hao, Beijing (CN); Xiulin Li, Beijing (CN); Jie Bai, Beijing (CN); Haiyuan Tang, Beijing (CN)

(73) Assignee: BAIDU ONLINE NETWORK TECHNOLOGY (Beijing) CO., LTD., Beijing (CN)

( * ) Notice: Subject to any disclaimer, the term of this patent is extended or adjusted under 35 U.S.C. 154(b) by 0 days.

(21) Appl. No.: 15/336,153

(22) Filed: Oct. 27, 2016

(65) Prior Publication Data

US 2017/0206886 A1 Jul. 20, 2017

(30) Foreign Application Priority Data

Jan. 19, 2016 (CN) ..... 2016 1 0034930

(51) Int. Cl.

| | |
|---|---|
| ***G10L 13/04*** | (2013.01) |
| ***G10L 13/047*** | (2013.01) |
| ***G10L 13/06*** | (2013.01) |
| ***G10L 13/10*** | (2013.01) |
| *G10L 13/02* | (2013.01) |

(52) U.S. Cl.

CPC ..... *G10L 13/047* (2013.01); *G10L 13/06* (2013.01); *G10L 13/10* (2013.01); *G10L 2013/021* (2013.01)

(58) Field of Classification Search

None

See application file for complete search history.

(56) References Cited

U.S. PATENT DOCUMENTS 7,136,816 B1 * 11/2006 Strom ..... G10L 13/10 704/260
2008/0154605 A1 * 6/2008 Morgan ..... G10L 13/047 704/258

FOREIGN PATENT DOCUMENTS

| | | | |
|---|---|---|---|
| CN | 1137727 | A | 12/1996 |
| JP | H05233565 | A | 9/1993 |
| JP | H05333900 | A | 12/1993 |
| JP | 2004020613 | A | 1/2004 |
| JP | 2013057734 | A | 3/2013 |
| WO | WO 2013189063 | A1 | 12/2013 |

OTHER PUBLICATIONS

Japanese Patent Application No. 2016201900, Office Action dated Dec. 5, 2017, 3 pages.

Japanese Patent Application No. 2016201900, English translation of Office Action dated Dec. 5, 2017, 3 pages.

(Continued)

*Primary Examiner* — Abul K Azad

(74) *Attorney, Agent, or Firm* — Lathrop Gage LLP

(57) ABSTRACT

The present invention provides a method and a device for optimizing speech synthesis system. The method comprises: receiving speech synthesis requests contained text messages; and determining the load level of the speech synthesis system when the speech synthesis requests are received; and selecting speech synthesis paths corresponding to the load level and synthesizing the text into speech according to the speech synthesis paths.

13 Claims, 2 Drawing Sheets

(56) References Cited

OTHER PUBLICATIONS

Korean Patent Application No. 1020160170531 Office Action dated Dec. 19, 2017, 3 pages.
Korean Patent Application No. 1020160170531 English translation of Office Action dated Dec. 19, 2017, 5 pages.
Chinese Patent Application No. 201610034930.8 English translation of Office Action dated Dec. 4, 2018, 10 pages.
Chinese Patent Application No. 201610034930.8 Office Action dated Dec. 4, 2018, 7 pages.

* cited by examiner

METHOD AND DEVICE FOR OPTIMIZING SPEECH SYNTHESIS SYSTEM

CROSS-REFERENCE TO RELATED APPLICATIONS

This application is based upon and claims a priority to Chinese Patent Application Serial No. 201610034930.8, filed on Jan. 19, 2016, the entire content of which is incorporated herein by reference.

FIELD

The present disclosure relates to a speech synthesis technology, and more particularly relates to a method and a device for optimizing a speech synthesis system.

BACKGROUND

With the rapid development of mobile internet and artificial intelligence technology, scenes of speech synthesis (such as voice broadcast, listening to novels or news, intelligent interaction, etc.) have been becoming more and more popular.

At present, when a speech synthesis system performs a speech synthesis on text, the input texts are normalized firstly. Then, operations such as word segmentation, part-of-speech tagging and phonetic notation are performed on the source text. In the next step, the prosodic hierarchy of text and acoustic parameters are predicted. Finally, the speech output is obtained.

However, the configuration of speech synthesis system is usually fixed, which cannot be set flexibly according to an actual scene and a condition of loading, such that it cannot adapt to speech synthesis requests under different environments. For example, when the speech synthesis system receives a large number of speech synthesis requests in a short period of time, the load capacity of speech synthesis system is likely to be out of bounds, which can lead to an accumulation of speech synthesis requests. As a result, users cannot receive feedback in time and their using experience will be affected.

SUMMARY

Embodiments of the present disclosure seek to solve at least one of the problems existing in the related art to at least some extent. Accordingly, a first objective of the present disclosure is to provide a method for optimizing a speech synthesis system. With the method for optimizing a speech synthesis system, a corresponding speech synthesis path may be selected flexibly according to the load level of the speech synthesis system. Thus, a stable service may be provided for users to avoid delay and users' using experiences are improved.

A second objective of the present disclosure is to provide a device for optimizing a speech synthesis system.

In order to achieve the above objectives, embodiments of a first aspect of the present disclosure provide a method for optimizing a speech synthesis system. The method includes: receiving speech synthesis requests containing text information; determining a load level of the speech synthesis system when the speech synthesis requests are received; and selecting a speech synthesis path corresponding to the load level and performing a speech synthesis on the text information according to the speech synthesis path.

With the method for optimizing a speech synthesis system according to embodiments of the present disclosure, the corresponding speech synthesis path may be selected flexibly according to the load level of the speech synthesis system so as to realize the speech synthesis, such that a stable service may be provided for users to avoid delay and users' using experiences are improved.

In order to achieve the above objectives, embodiments of a second aspect of the present disclosure provide a device for optimizing a speech synthesis system. The device includes: a receiving module, configured to receive speech synthesis requests containing text information; a determining module, configured to determine a load level of the speech synthesis system when the speech synthesis requests are received; and a synthesizing module, configured to select a speech synthesis path corresponding to the load level and to perform a speech synthesis on the text information according to the speech synthesis path.

With the device for optimizing a speech synthesis system according to embodiments of the present disclosure, the corresponding speech synthesis path may be selected flexibly according to the load level of the speech synthesis system so as to realize the speech synthesis, such that a stable service may be provided for users to avoid delay and users' using experiences are improved.

DETAILED DESCRIPTION

Figure 1:
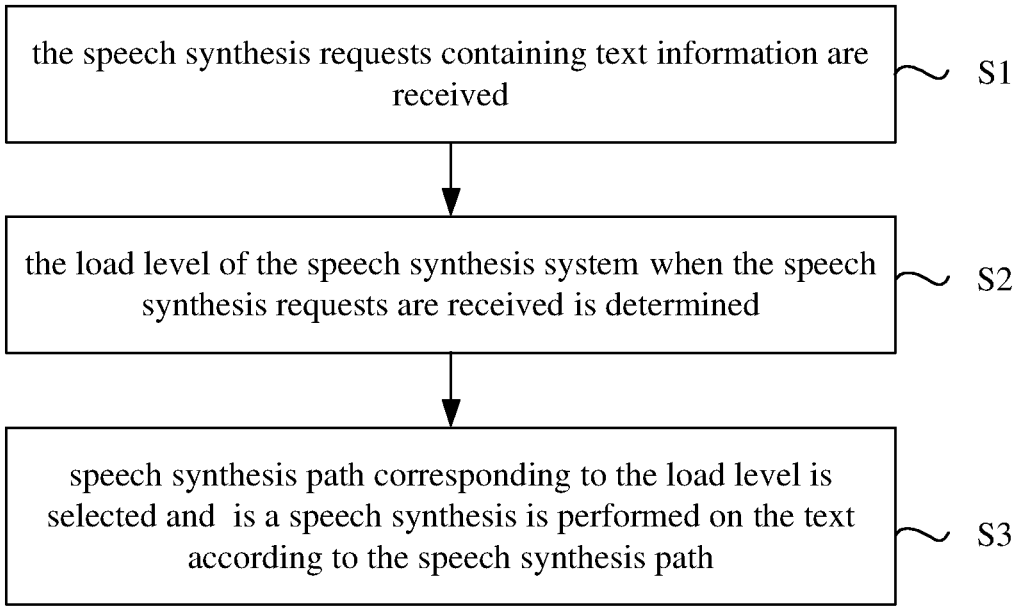
FIG. 1 is a flow chart of a method for optimizing a speech synthesis system according to an embodiment of the present disclosure.

Reference will be made in detail to embodiments of the present disclosure, where the same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

The method and device for optimizing a speech synthesis system according to embodiments of the present disclosure will be described with reference to drawings.

FIG. 1 is a flow chart of a method for optimizing a speech synthesis system according to an embodiment of the present disclosure.

As shown in FIG. 1, the method for optimizing a speech synthesis system may include the followings.

In act S1, speech synthesis requests containing text information are received.

Specifically, the speech synthesis request may include a series of scenes such as converting text information like short messages sent from friends into a speech, converting text information in a novel into a speech to be played, etc..

In an embodiment, speech synthesis requests sent from a user through various clients (such as web client, APP client etc.) may be received.

In act S2, a load level of the speech synthesis system when the speech synthesis requests are received is determined.

Specifically, when the speech synthesis requests are received, the number of the speech synthesis requests received by the speech synthesis system at current time and average response time corresponding to these speech synthesis requests are obtained, and then the load level is determined according to the number of speech synthesis requests and the average response time. If the number of speech synthesis requests is less than a capability of responding to requests (the capability may be indicated by the number of requests that the speech synthesis system is able to process) and a length of the average response time is less than that of a pre-set time period, the load level is determined as a first level. If the number of speech synthesis requests is less than the capability of responding to requests and the length of the average response time is greater than or equal to that of the pre-set time period, the load level is determined as a second level. If the number of speech synthesis requests is greater than or equal to the capability of responding to requests, the load level is determined as a third level.

For example, the background of speech synthesis system consists of a server cluster. Assume that the capability of responding to requests of the server cluster is 500 requests per second, if the speech synthesis system receives 100 speech synthesis requests within one second, and the average response time of the 100 speech synthesis requests is less than the pre-set time period (i.e., 500 milliseconds), then it may be determined that the speech synthesis system is not overloaded and performs well, such that the load level is the first level. Assume that the speech synthesis system receives 100 speech synthesis requests within one second but the average response time of the 100 speech synthesis requests is greater than the pre-set time period (i.e., 500 milliseconds), it may be determined that the speech synthesis system is not overloaded but the performance is decreased, such that, the load level is the second level. Assume that the speech synthesis system receives 1000 speech synthesis requests within one second, it indicates that the speech synthesis system is overloaded, such that the load level is the third level.

In step S3, a speech synthesis path corresponding to the load level is selected and a speech synthesis is performed on the text according to the speech synthesis path.

When the load level is the first level, a first speech synthesis path corresponding to the first level may be selected to be used to perform the speech synthesis on the text information. The first speech synthesis path may include a long short term memory (LSTM) model and a waveform splicing model, in which a first parameter is used for setting the waveform splicing model.

When the load level is the second level, a second speech synthesis path corresponding to the second level may be selected to be used to perform the speech synthesis on the text information. The second speech synthesis path may include a HMM-based Speech Synthesis System (HTS) model and a waveform splicing model, in which a second parameter is used for setting the waveform splicing model.

When the load level is the third level, a third speech synthesis path corresponding to the third level can be selected to be used to perform the speech synthesis on the text information. The third speech synthesis path may include a HMM-based Speech Synthesis System (HTS) model and a vocoder model.

In an embodiment, when the speech synthesis system perform a speech synthesis on the text information, a text pre-processing module is configured to normalize input text; a text analysis module is configured to perform operations such as word segmentation, part-of-speech tagging and phonetic notation on the text; a prosodic hierarchy predicting module is configured to predict the prosodic hierarchy of text; an acoustic model module is configured to predict acoustic parameters; and a speech synthesis module is configured to output the final speech results. The five modules mentioned above constitute a path to realize speech synthesis.

The acoustic model module may be implemented based on the HTS model or LSTM model. The computing performance of the acoustic model based on HTS is better than that of the acoustic model based on LSTM, which means that the former model is less time-consuming. On the other hand, the later model is better than the former model on the term of the natural fluency of speech synthesis. Likewise, a parameter generating method based on the vocoder model or a splicing generating method based on the waveform splicing model may be used in speech synthesis module. The speech synthesis based on the vocoder model is less resource-consuming and time-consuming, while the speech synthesis based on the waveform splicing model is more resource-consuming and time-consuming with a high quality of speech synthesis.

In other words, a number of different paths may be combined during the speech synthesis because there are several alternatives in some modules. For example, when the load level is the first level, the speech synthesis system performs well, so the acoustic model based on LSTM and the waveform splicing model may be selected to obtain a better speech synthesis effect. When spliced units to be synthesized are selected in the waveform splicing model, the thresholds of parameters (such as context parameters, Kullback-Leibler divergence (KLD) distance parameters and acoustic parameters, etc.) may be set into the first parameter, so as to increase the number of spliced units. Although the computational work is increased, well-qualified spliced units may be selected from the spliced units to be synthesized, such that the effect of speech synthesis may be improved. When the load level is the second level, the performance of the speech synthesis system is affected to some extent, so the HTS model and the waveform splicing model may be selected to obtain an appropriate speech synthesis effect and to ensure a faster processing speed. When the spliced units to be synthesized are selected in the waveform splicing model, the thresholds of parameters (such as context parameters, KLD distance parameters and acoustic parameters, etc.) may be set into the second parameter, so as to decrease the number of spliced units and to improve the response speed under the condition of the certain quality of speech synthesis. When the load level is the third level, the speech synthesis system is overload. Therefore, the HTS model and the vocoder model need to be selected to guarantee a faster response speed and to ensure that users can receive feedback results of speech synthesis in time.

With the method for optimizing a speech synthesis system according to embodiments of the present disclosure, by receiving speech synthesis requests containing text information, determining the load level of the speech synthesis system when the speech synthesis requests are received, and selecting the speech synthesis path corresponding to the load level and performing the speech synthesis on the text information according to the speech synthesis path, the corresponding speech synthesis path may be selected flexibly according to the load level to realize the speech synthesis. In this way, a stable service may be provided for users to avoid delay and users' using experiences are improved.

Figure 2:
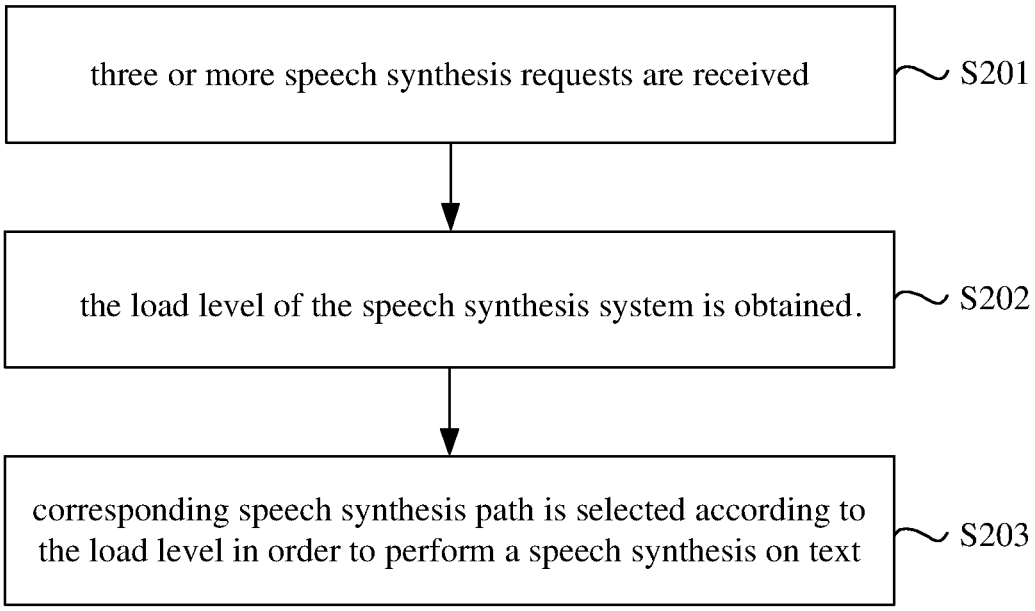
FIG. 2 is a flow chart of a method for optimizing a speech synthesis system according to a specific embodiment of the present disclosure.

FIG. 2 is a flow chart of a method for optimizing a speech synthesis system according to a specific embodiment of the present disclosure.

As shown in FIG. 2, the method for optimizing a speech synthesis system may include the followings.

In act S201, a plurality of speech synthesis requests are received.

Figure 3:
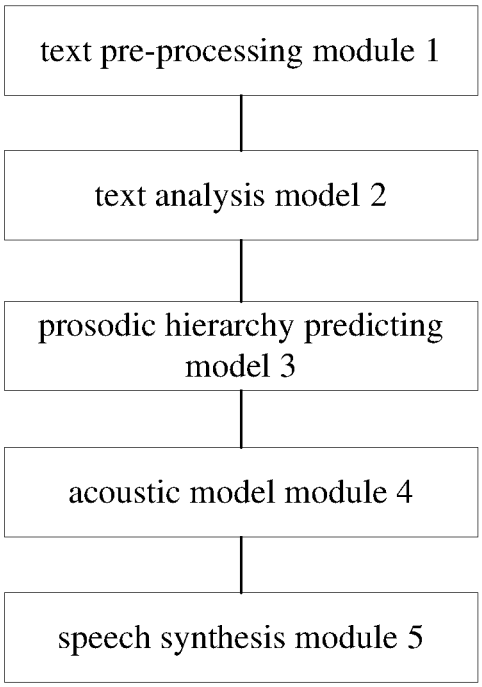
FIG. 3 is a block diagram of a speech synthesis system according to a specific embodiment of the present disclosure.

The framework of the speech synthesis system will be described firstly. When the speech synthesis system performs a speech synthesis on the text information, the input texts are normalized through a text pre-processing module 1; operations such as word segmentation, part-of-speech tagging and phonetic notation are performed on the text through a text analysis model 2; the prosodic hierarchy of text is predicted through a prosodic hierarchy predicting module 3 and the acoustic parameters are predicted through an acoustic model module 4; the final speech results are output by a speech synthesis module 5. As shown in FIG. 3, the five modules mentioned above constitute the path to realize speech synthesis, in which the acoustic model module 4 may be implemented based on the HTS model (i.e., path 4A) or based on the LSTM model (i.e., path 4B). The computing performance of the acoustic model based on HTS is better than that of the acoustic model based on LSTM, which means that the former model is less time-consuming. On the other hand, the later model is better than the former model on the term of the natural fluency of speech synthesis. Likewise, the speech synthesis module 5 may adopt a parameter generating method based on the vocoder model (i.e., path 5A) or adopt a splicing generating method based on the waveform splicing model (i.e., path 5B). The speech synthesis based on the vocoder model is less resource-consuming and time-consuming, while the speech synthesis based on the waveform splicing model is more resource-consuming and time-consuming with a high quality of speech synthesis.

The splicing generating method based on the waveform splicing model includes two ways. First way, when the spliced units to be synthesized are selected in the waveform splicing model , the thresholds of parameters (such as context parameters, KLD distance parameters and acoustic parameters, etc.) may be set with the first parameter (i.e., path 6A), so as to increase the number of spliced units. Although the computational work is increased, well-qualified spliced units may be selected from the spliced units to be synthesized, such that the effect of speech synthesis may be improved. Second way, when the spliced unit to be synthesized are selected in the waveform splicing model, the thresholds of parameters (such as context parameters, KLD distance parameters and acoustic parameters, etc.) may be set based on the second parameter (i.e., path 6B), so as to decrease the number of spliced units and to improve the response speed under the condition of the certain quality of speech synthesis. Therefore, the speech synthesis system provides several paths to dynamically adapt to different scenes.

In an embodiment, the speech synthesis system may receive speech synthesis requests sent from the user through web clients or app clients. For example, some users may send the speech synthesis requests through web clients and some users may send the speech synthesis requests through app clients.

In step S202, a load level of the speech synthesis system is obtained.

Specifically, Query Per Second (QPS, indicating the number of speech synthesis requests to which the system may respond per second) and average response time to the speech synthesis requests may be obtained under the condition that the speech synthesis system has the best speech synthesis effect, and then the load level of the speech synthesis system may be divided into three levels according to the above indices. In a first load level, the current load of speech synthesis request is less than QPS and the average response time is less than 500 ms; in a second load level, the current load of speech synthesis request is less than QPS and the average response time is greater than 500 ms; in a third load level, the current load of speech synthesis request is greater than QPS.

In step S203, a corresponding speech synthesis path is selected according to the load level in order to perform a speech synthesis on text.

After the load level is determined, the speech synthesis path may be selected dynamically according to the load level.

In the first load level: the current load of speech synthesis request is less than QPS and the average response time is less than 500 ms, it indicates that the speech synthesis system has a good performance, a path which has a better speech synthesis effect but is time-consuming (i.e., path 4B-5B-6A) may be selected.

In the second load level: the current load of speech synthesis request is less than QPS but the average response time exceeds 500 ms, it indicates that the performance of the speech synthesis system is affected. Thus, the path 4A-5B-6B may be selected to improve the response speed.

In the third load level: the current load of speech synthesis request is greater than QPS, it indicates that the speech synthesis system is overload. Thus, the path which is time-saving and has a faster computing speed (i.e., path 4A-5A) may be selected dynamically.

In addition, the speech synthesis path may be planned flexibly by the speech synthesis system according to different application scenarios of speech synthesis. For example, the reading of novels and news has high requirements for the quality of speech synthesis results, so the speech synthesis request for this may be defined as X type speech synthesis request; on the other hand, voice broadcast and interaction with a robot has low requirements for the quality of speech synthesis results, so the speech synthesis request for this may be defined as Y type speech synthesis request.

When the load level is the first level, the received speech synthesis requests are processed by using the path which has a better speech synthesis effect but is time-consuming, i.e., path 4B-5B-6A.

When the load level has reached the second level, the speech synthesis effect of the Y type speech synthesis request is reduced firstly, which means that, for the Y type speech synthesis request, it is adjusted to perform the speech synthesis through the path 4A-5B-6B. Because the Y type speech synthesis request uses a time-saving speech synthesis path, the average response time of speech synthesis request may be reduced. If the reduced response time satisfies the requirement of the second level, for the X type speech synthesis request, the path 4B-5B-6A may be used to obtain a better synthesis effect; if the reduced response time cannot satisfy the requirement of the second level, for all the speech synthesis requests, the path 4A-5B-6B would be used to perform the speech synthesis.

In the same way, when the load level has reached the third level, the speech synthesis effect of the Y type speech synthesis request is reduced firstly, which means that, for Y type the speech synthesis request, it is adjusted to perform the speech synthesis through the path 4A-5A in order to reduce the average response time of speech synthesis request. If the reduced response time is less than 500 ms, for the X type speech synthesis request, the path 4B-5B-6A may be used to perform the speech synthesis, otherwise the path 4A-5B-6B may be used to perform the speech synthesis; if the reduced response time still exceeds 500 ms, for all the speech synthesis requests, the path 4A-5A would be used to perform the speech synthesis.

Thus, the speech synthesis system may deal with different application scenarios flexibly and provide users with stable speech synthesis service. Under the premise of not increasing hardware cost, the speech synthesis system may provide active coping strategies and avoid delay of feedback results for users in the peak time of speech synthesis requests.

In order to implement the above embodiments, the present disclosure provides a device for optimizing a speech synthesis system.

Figure 4:
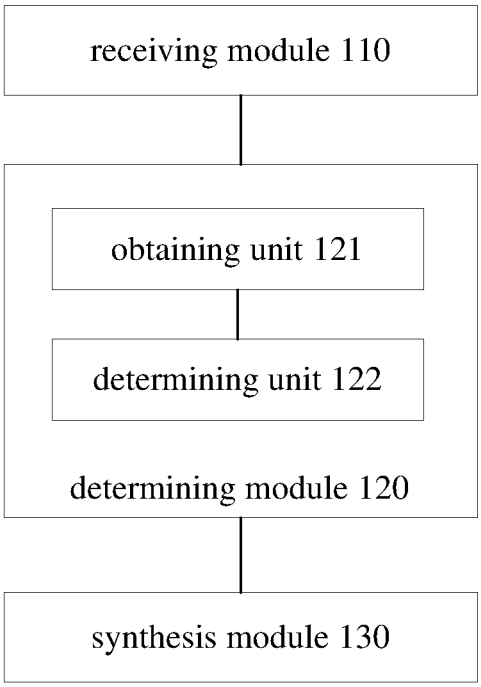
FIG. 4 is a block diagram of a device for optimizing a speech synthesis system according to an embodiment of the present disclosure.

FIG. 4 is a block diagram of a device for optimizing a speech synthesis system according to an embodiment of the present disclosure.

As shown in FIG. 4, the device for optimizing a speech synthesis system may include: a receiving module 110, a determining module 120 and a synthesis module 130, in which the determining module 120 may include an obtaining unit 121 and a determining unit 122.

The receiving module 110 is configured to receive speech synthesis requests containing text information. The speech synthesis requests include several scenarios. For example, converting text information such as short messages sent from friends to a speech, converting text information of novels to a speech to be played, etc.

In an embodiment, the receiving module 110 may receive speech synthesis requests sent from a user through various clients such as web client, APP client etc.

The determining module 120 is configured to determine a load level of the speech synthesis system when the speech synthesis requests are received. Specifically, when the speech synthesis requests are received, the obtaining unit 121 may obtain a number of speech synthesis requests at current time and average response time corresponding to the speech synthesis requests, and then the determining unit 122 may determine the load level according to the number of speech synthesis requests and the average response time. If the number of speech synthesis requests is less than a capability of responding to requests and a length of the average response time is less than that of a pre-set time period, the load level is determined as a first level; if the number of speech synthesis requests is less than the capability of responding to requests and the length of the average response time is greater than or equal to that of the pre-set time period, the load level is determined as a second level; if the number of speech synthesis requests is greater than or equal to the capability of responding to requests, the load level is determined as a third level.

For example, the background of the speech synthesis system consists of a server cluster. Assume that the capability of responding to requests of server cluster is 500 requests per second, if the speech synthesis system receives 100 speech synthesis requests within one second and the average response time of the 100 speech synthesis requests is less than the pre-set time period (i.e., 500 milliseconds), it indicates that the speech synthesis system is not overload and performs well, such that the load level is the first level; if the speech synthesis system receives 100 speech synthesis requests within one second but the average response time of the 100 speech synthesis requests exceeds the pre-set time period (i.e., 500 milliseconds), it indicates that the speech synthesis system is not overload but the performance is decreased, such that the load level is the second level; if the speech synthesis system receives 1000 speech synthesis requests within one second, it indicates that the speech synthesis system is overload, such that the load level is the third level.

The synthesis module 130 is configured to select a speech synthesis path corresponding to the load level and to perform a speech synthesis on the text information according to the speech synthesis path.

When the load level is the first level, a first speech synthesis path corresponding to the first level may be selected by the synthesis module 130 to perform the speech synthesis on the text information. The first speech synthesis path may include an LSTM model and a waveform splicing model, in which a first parameter is used for setting the waveform splicing model.

When the load level is the second level, a second speech synthesis path corresponding to the second level may be selected by the synthesis module 130 to perform the speech synthesis on the text information. The second speech synthesis path may include an HTS model and a waveform splicing model, in which a second parameter is used for setting the waveform splicing model.

When the load level is the third level, a third speech synthesis path corresponding to the third level may be selected by the synthesis module 130 to perform the speech synthesis on the text information. The third speech synthesis path may include the HTS model and a vocoder model.

In an embodiment, when the speech synthesis system perform a speech synthesis on the text information, a text pre-processing module is configured to normalize input text; a text analysis module is configured to perform operations such as word segmentation, part-of-speech tagging and phonetic notation on the text; a prosodic hierarchy predicting module is configured to predict the prosodic hierarchy of text; an acoustic model module is configured to predict acoustic parameters; and a speech synthesis module is configured to output the final speech results. The five modules mentioned above constitute a path to realize speech synthesis.

The acoustics model module may be implemented based on the HTS model or LSTM model. The computing performance of the acoustic model based on HTS is better than that of the acoustic model based on LSTM, which means that the former model is less time-consuming. On the other hand, the later model is better than the former model on the term of the natural fluency of speech synthesis. Likewise, a parameter generating method based on the vocoder model or a splicing generating method based on the waveform splicing model may be used in speech synthesis module. The speech synthesis based on the vocoder model is less resource-consuming and time-consuming, while the speech synthesis based on the waveform splicing model is more resource-consuming and time-consuming with a high quality of speech synthesis.

In other words, a number of different paths may be combined in the process of speech synthesis because there are several alternatives in some modules. For example, when the load level is the first level, the speech synthesis system performs well, so the acoustic model based on LSTM and the waveform splicing model may be selected to obtain a better speech synthesis effect. When the spliced units to be synthesized are selected in the waveform splicing model, the thresholds of parameters (such as context parameters, Kullback-Leibler divergence (KLD) distance parameters and acoustic parameters, etc.) may be set to the first parameter, so as to increase the number of spliced units which are selected. Although the computational work is increased, well-qualified spliced units may be selected from the increasing spliced units to be synthesized, such that the effect of speech synthesis may be improved. When the load level is the second level, the performance of the speech synthesis system is affected to some extent, so the HTS model and the waveform splicing model may be selected to obtain an appropriate speech synthesis effect and to ensure a faster processing speed. When the spliced units to be synthesized are selected in the waveform splicing model, the thresholds of parameters (such as context parameters, KLD distance parameters and acoustic parameters, etc.) may be set into the second parameter, so as to decrease the number of spliced units and to improve the response speed under the condition of the certain quality of speech synthesis. When the load level is the third level, the speech synthesis system is overload. Therefore, the HTS model and the vocoder model are selected to guarantee the fastest response speed and to ensure that users can receive feedback results of speech synthesis in time.

With the method for optimizing a speech synthesis system according to embodiments of the present disclosure, by receiving speech synthesis requests containing text information, determining the load level of the speech synthesis system when the speech synthesis requests are received, and selecting the speech synthesis path corresponding to the load level and performing the speech synthesis on the text information according to the speech synthesis path, the corresponding speech synthesis path may be selected flexibly according to the load level to realize the speech synthesis. In this way, a stable service may be provided for users to avoid delay and users' using experiences are improved.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "one embodiment", "some embodiments," "an embodiment", "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, in a case without contradictions, different embodiments or examples or features of different embodiments or examples may be combined by those skilled in the art.

Although explanatory embodiments have been shown and described, it would be appreciated that the above embodiments are explanatory and cannot be construed to limit the present disclosure, and changes, alternatives, and modifications can be made in the embodiments without departing from scope of the present disclosure by those skilled in the art.

What is claimed is:

1. A method for optimizing a speech synthesis system, comprising:

receiving, at a server of the speech synthesis system, speech synthesis requests comprising text information;

determining, via execution of computer readable instructions at the server, a load level of the speech synthesis system when the speech synthesis requests are received, according to a number of the speech synthesis requests received by the speech synthesis system at current time and an average response time corresponding to the speech synthesis requests, the determining a load level of the speech synthesis system comprising:

determining the load level as a first level when the number of the speech synthesis requests is less than a capability of responding to requests and a length of the average response time is less than that of a pre-set time period, determining the load level as a second level when the number of the speech synthesis requests is less than the capability of responding to requests and the length of the average response time is greater than or equal to that of the pre-set time period, and determining the load level as a third level when the number of the speech synthesis requests is greater than or equal to the capability of responding to requests; and selecting, via execution of computer readable instructions at the server, a speech synthesis path corresponding to the load level and performing a speech synthesis on the text information according to the speech synthesis path, the selecting a speech synthesis path comprising:

selecting a first speech synthesis path corresponding to the first level to perform the speech synthesis on the text information according to the first speech synthesis path, when the load level is the first level, selecting a second speech synthesis path corresponding to the second level to perform the speech synthesis on the text information according to the second speech synthesis path, when the load level is the second level, and selecting a third speech synthesis path corresponding to the third level to perform the speech synthesis on the text information according to the third speech synthesis path, when the load level is the third level.

2. The method according to claim 1, wherein the speech synthesis path is consisted of at least one act selected from following acts of:

normalizing the text information;

performing an analysis operation on the text information;

predicting a prosodic hierarchy of the text information;

predicting acoustic parameters; and outputting a speech result.

3. The method according to claim 2, wherein the analysis operation comprises a word segmentation, a part-of-speech tagging and a phonetic notation.

4. The method according to claim 1, wherein the first speech synthesis path comprises a Long short term memory model and a waveform splicing model, in which the waveform splicing model is set with a first parameter.

5. The method according to claim 1, wherein the second speech synthesis path comprises a Hidden Markov Model-Based Speech Synthesis System model and a waveform splicing model, in which the waveform splicing model is set with a second parameter.

6. The method according to claim 1, wherein the third speech synthesis path comprises a Hidden Markov Model-Based Speech Synthesis System model and a vocoder model.

7. A device for optimizing a speech synthesis system, comprising:

a processor; and a memory configured to store an instruction executable by the processor;

wherein the processor is configured to:

receive speech synthesis requests comprising text information;

determine a load level of the speech synthesis system when the speech synthesis requests are received, according to a number of the speech synthesis requests received by the speech synthesis system at current time and an average response time corresponding to the speech synthesis requests by acts of:

determining the load level as a first level when the number of the speech synthesis requests is less than a capability of responding to requests and a length of the average response time is less than that of a pre-set time period, determining the load level as a second level when the number of the speech synthesis requests is less than the capability of responding to requests and the length of the average response time is greater than or equal to that of the pre-set time period, and determining the load level as a third level when the number of the speech synthesis requests is greater than or equal to the capability of responding to requests; and select a speech synthesis path corresponding to the load level and to perform a speech synthesis on the text information according to the speech synthesis path by acts of:

selecting a first speech synthesis path corresponding to the first level to perform the speech synthesis on the text information according to the first speech synthesis path, when the load level is the first level;

selecting a second speech synthesis path corresponding to the second level to perform the speech synthesis on the text information according to the second speech synthesis path, when the load level is the second level; and selecting a third speech synthesis path corresponding to the third level to perform the speech synthesis on the text information according to the third speech synthesis path, when the load level is the third level.

8. The device according to claim 7, wherein the speech synthesis path is consisted of at least one act selected from following acts of:

normalizing the text information;

performing an analysis operation on the text information;

predicting a prosodic hierarchy of the text information;

predicting acoustic parameters; and outputting a speech result.

9. The device according to claim 8, wherein the analysis operation comprises a word segmentation, a part-of-speech tagging and a phonetic notation.

10. The device according to claim 7, wherein the first speech synthesis path comprises a Long short term memory model and a waveform splicing model, in which the waveform splicing model is set with a first parameter.

11. The device according to claim 7, wherein the second speech synthesis path comprises a Hidden Markov Model-Based Speech Synthesis System model and a waveform splicing model, in which the waveform splicing model is set with a second parameter.

12. The device according to claim 7, wherein the third speech synthesis path comprises a Hidden Markov Model-Based Speech Synthesis System model and a vocoder model.

13. A program product having stored therein instructions that, when executed by one or more processors of a device, causes the device to perform the method for optimizing a speech synthesis system, wherein the method comprises:

receiving speech synthesis requests comprising text information;

determining a load level of the speech synthesis system when the speech synthesis requests are received, according to a number of the speech synthesis requests received by the speech synthesis system at current time and an average response time corresponding to the speech synthesis requests by acts of:

determining the load level as a first level when the number of the speech synthesis requests is less than a capability of responding to requests and a length of the average response time is less than that of a pre-set time period, determining the load level as a second level when the number of the speech synthesis requests is less than the capability of responding to requests and the length of the average response time is greater than or equal to that of the pre-set time period, and determining the load level as a third level when the number of the speech synthesis requests is greater than or equal to the capability of responding to requests; and selecting a speech synthesis path corresponding to the load level and performing a speech synthesis on the text information according to the speech synthesis path by acts of:

selecting a first speech synthesis path corresponding to the first level to perform the speech synthesis on the text information according to the first speech synthesis path, when the load level is the first level;

selecting a second speech synthesis path corresponding to the second level to perform the speech synthesis on the text information according to the second speech synthesis path, when the load level is the second level; and selecting a third speech synthesis path corresponding to the third level to perform the speech synthesis on the text information according to the third speech synthesis path, when the load level is the third level.

* * * * *